US010364941B2

(12) United States Patent
Kriese

(10) Patent No.: US 10,364,941 B2
(45) Date of Patent: Jul. 30, 2019

(54) MODULAR GAS EXTRACTION SYSTEM FOR PRESSURIZED GAS BOTTLES

(71) Applicant: Messer GasPack GmbH, Krefeld (DE)

(72) Inventor: Alexander Kriese, Baden bei Wien (AT)

(73) Assignee: Messer GasPack GmbH, Krefeld (DE)

( * ) Notice: Subject to any disclaimer, the term of this patent is extended or adjusted under 35 U.S.C. 154(b) by 0 days.

(21) Appl. No.: 15/565,596

(22) PCT Filed: Apr. 26, 2016

(86) PCT No.: PCT/EP2016/059301
§ 371 (c)(1),
(2) Date: Oct. 10, 2017

(87) PCT Pub. No.: WO2016/174039
PCT Pub. Date: Nov. 3, 2016

(65) Prior Publication Data

US 2018/0112825 A1 Apr. 26, 2018

(30) Foreign Application Priority Data

Apr. 29, 2015 (DE) ..... 10 2015 005 599

(51) Int. Cl.
*F17C 13/06* (2006.01)
*F17C 1/00* (2006.01)

(52) U.S. Cl.
CPC ..... *F17C 13/06* (2013.01); *F17C 1/00* (2013.01); *F17C 2201/0109* (2013.01);
(Continued)

(58) Field of Classification Search
CPC ..... F17C 2205/0308; F17C 13/06; F17C 2205/0323; F17C 2205/0329;
(Continued)

(56) References Cited

U.S. PATENT DOCUMENTS 1,353,321 A * 9/1920 Crommett ..... F16K 1/305
137/493
1,413,502 A * 4/1922 Steinmetz ..... F17C 13/06
137/382

(Continued)

FOREIGN PATENT DOCUMENTS

DE 19744048 A1 * 4/1999 ..... F16K 1/305
DE 10146457 B4 * 11/2006 ..... F17C 13/04

(Continued)

OTHER PUBLICATIONS

International Search Report and Written Opinion of the European Patent Office with respect to corresponding PCT International Application No. PCT/EP2016/059301, dated Nov. 3, 2016.

*Primary Examiner* — Reinaldo Sanchez-Medina
*Assistant Examiner* — David Colon-Morales
(74) *Attorney, Agent, or Firm* — Andrus Intellectual Property Law, LLP

(57) ABSTRACT

Pressurized gas bottles with integrated valves, in which a plurality of functional supports are integrated in an extraction unit, are equipped with complex fall protection means. Moreover, in such a valve, a new approval procedure is carried out for the entire valve in the event of multiple modifications, for example when supplementing it with an additional function. In order to reduce the effort associated with this, an extraction fitting for a pressurized gas bottle is provided with a modular design, wherein a base module comprising the shut-off member and a fall protection device securing the shut-off member complies with legal requirements regarding fall protection and the shut-off device of the pressurized gas bottle. All further functionalities of the extraction fitting are integrated in at least one additional module, which is connected to the base module in a fixed but removable manner and without impairing the fall safety.

19 Claims, 1 Drawing Sheet

Figure 1:
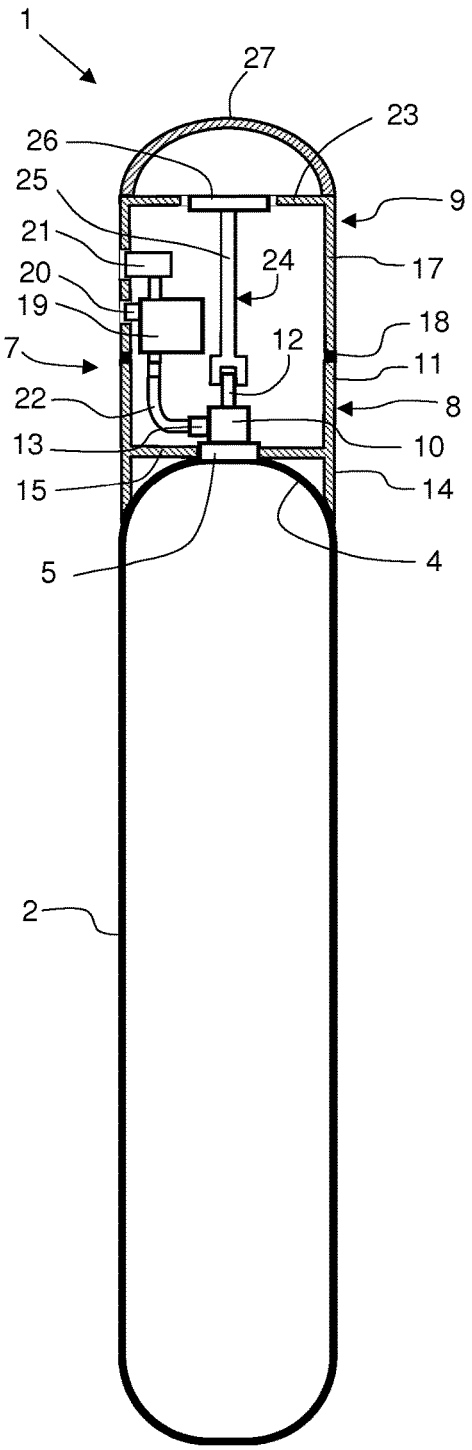

(52) U.S. Cl.
CPC .. *F17C 2201/056* (2013.01); *F17C 2201/058* (2013.01); *F17C 2205/0165* (2013.01); *F17C 2205/0308* (2013.01); *F17C 2205/0323* (2013.01); *F17C 2205/0329* (2013.01); *F17C 2205/0338* (2013.01); *F17C 2221/011* (2013.01); *F17C 2221/013* (2013.01); *F17C 2221/014* (2013.01); *F17C 2221/016* (2013.01); *F17C 2221/018* (2013.01); *F17C 2221/03* (2013.01); *F17C 2221/031* (2013.01); *F17C 2223/0123* (2013.01); *F17C 2223/035* (2013.01); *F17C 2223/036* (2013.01); *F17C 2250/043* (2013.01); *Y10T 137/7062* (2015.04); *Y10T 137/7065* (2015.04)

(58) Field of Classification Search
CPC ..... F17C 2205/0332; F17C 2205/0338; F17C 2250/043; F17C 2205/0165; Y10T 137/7062; Y10T 137/7065
See application file for complete search history.

(56) References Cited

U.S. PATENT DOCUMENTS 1,833,924 A * 12/1931 Wayer ..... F17C 13/06 137/382
1,948,953 A * 2/1934 Wayer ..... F17C 13/06 220/298
2,919,981 A * 1/1960 Calva ..... B01F 3/02 261/95
4,332,331 A * 6/1982 Fawley ..... F17C 13/002 137/382
4,493,434 A * 1/1985 Beaujean ..... F16K 1/306 137/630.14
4,521,676 A * 6/1985 Poulsen ..... F17C 13/003 220/724
4,582,217 A * 4/1986 Proctor ..... F17C 13/06 220/288
4,600,033 A * 7/1986 Baron ..... F17C 13/002 137/382
4,834,137 A * 5/1989 Kawaguchi ..... F17C 13/123 137/312
4,895,345 A * 1/1990 Gladbach ..... F17C 13/002 137/382
4,944,424 A * 7/1990 Wood, Jr. ..... B65D 50/046 137/382
5,088,685 A * 2/1992 Salvucci, Sr. ..... F17C 13/085 220/582
5,099,567 A * 3/1992 Kitsuda ..... F17C 13/002 29/453
5,158,204 A * 10/1992 Martrich ..... F17C 13/06 220/304
5,429,152 A * 7/1995 Van Straaten ..... F17C 13/002 137/377
5,794,645 A * 8/1998 Rohrberg ..... F17C 13/003 137/1
6,311,722 B1 * 11/2001 Gounot ..... F17C 13/06 137/377
6,415,946 B2 * 7/2002 Carlo ..... F17C 13/04 220/724
6,732,996 B1 5/2004 Kremer
6,955,194 B2 * 10/2005 MacNeal ..... F16L 29/02 141/18
7,089,956 B1 8/2006 Davidson et al.
7,114,510 B2 * 10/2006 Peters ..... F16K 31/60 137/1
7,287,548 B2 * 10/2007 Bleys ..... F16K 1/304 137/505.25
7,703,821 B2 * 4/2010 Swain ..... F17C 13/002 220/724
8,322,569 B2 12/2012 Udischas et al.
8,534,312 B2 * 9/2013 Burgess ..... F17C 13/06 137/377
9,273,799 B2 * 3/2016 Fowler ..... F16K 37/005
9,665,107 B2 * 5/2017 Pemberton ..... F16K 31/602
2006/0065672 A1 * 3/2006 Lecourt ..... F17C 1/04 222/3
2008/0095607 A1 4/2008 Hagstrom et al.
2009/0038691 A1 * 2/2009 Birch ..... F16K 1/307 137/382
2014/0130875 A1 5/2014 Fowler et al.
2014/0251456 A1 * 9/2014 Cesbron ..... A61M 16/20 137/382
2015/0260343 A1 * 9/2015 Baune ..... F17C 1/00 206/0.6
2015/0260344 A1 * 9/2015 Frenal ..... F17C 13/06 206/0.6
2016/0178130 A1 * 6/2016 Pemberton ..... F17C 13/06 220/581

FOREIGN PATENT DOCUMENTS

DE 10057424 B4 * 12/2006 ..... F17C 13/002
EP 0447315 A1 * 9/1991 ..... F17C 13/003
EP 2586481 A1 5/2013
EP 2835573 A1 2/2015
WO 2004081422 A2 9/2004
WO 2006060338 A2 6/2006
WO 2008052022 A2 5/2008
WO 2008149312 A1 12/2008

* cited by examiner

MODULAR GAS EXTRACTION SYSTEM FOR PRESSURIZED GAS BOTTLES

CROSS-REFERENCE TO RELATED APPLICATIONS

This application is the U.S. national stage application of International Application PCT/EP2016/059301, filed Apr. 26, 2016, which international application was published on Nov. 3, 2016, as International Publication WO 2016/174039 in the German language. The international application is incorporated herein by reference, in entirety. The international application claims priority to German Patent Application No. 10 2015 005 599.2, filed Apr. 29, 2015, which is incorporated herein by reference, in entirety.

The invention relates to a pressurized gas bottle with an extraction fitting which has a shut-off member mounted on the pressurized gas bottle, at least one additional functional component attached to the shut-off member, and at least one fall protection device securing at least the shut-off member against inadmissible damage.

Legal provisions governing the fall safety of pressurized gas bottles stipulate that, if the pressurized gas bottle falls from a height of 1.20 m, the shut-off member of the pressurized gas bottle must remain closed and the gas contained in the pressurized gas bottle must not escape uncontrollably and, moreover, the pressurized gas bottle must be able to be safely opened and emptied after the fall. To this end, the pressurized gas bottle has to be equipped with a suitably robust shut-off member, with a fall protection device, or with a suitable combination of both. The fall protection device is generally designed as a safety element in the form of a yoke, collar or cage made of metal or plastic and mounted on the neck of the pressurized gas bottle, which safety element at least partially encloses the shut-off member and in this way protects it from a direct impact.

Legal provisions governing shut-off fittings for pressurized gas bottles also stipulate extensive authorization and approval procedures involving, among other things, durability tests, fire resistance tests and, in the case of oxygen, oxygen pressure surge tests.

In recent years, so-called "integrated valves" (VIPR) have been launched on the market by various manufacturers. Integrated valves, in addition to having a shut-off member, also include further functional components arranged in a compact manner inside a housing, for example pressure regulators, flow regulators, display devices, one or more attachments for extraction of gas and/or for filling the pressurized gas bottle. Examples of integrated valves are found, for example, in U.S. Pat. No. 8,322,569 B2, U.S. Pat. No. 6,732,996 B1, U.S. Pat. No. 8,534,312 B2, WO 2008/052022 A2 or US 2008/0095607 A1. The legally prescribed requirements must in this case be met in respect of the whole arrangement with all the fittings integrated therein. However, this entails considerable development costs, since dedicated tools have to be developed for the housings of each valve type and, moreover, the requirements governing fall safety can be very high in the case of complex valves. The required compactness of the integrated valves is also a cost driver.

A further aspect in this connection is that, in order to repair such valves, the gas bottle generally has to be completely emptied, after which the entire valve is replaced by a new one, and it is only then that the repair is carried out on the dismantled valve. In addition to the work involved in the dismantling and fitting, this results in additional costs, since the gas bottle is unusable for a certain period of time.

The object of the invention is therefore to make available a pressurized gas bottle with an extraction fitting which on the one hand meets the legal requirements governing fall safety and shut-off fitting and which, on the other hand, can be equipped with functionalities that are required for a pressurized gas bottle with integrated valve.

In a pressurized gas bottle of the type and purpose mentioned at the outset, this object is achieved by the fact that the extraction fitting has a modular design and has a base module, comprising the shut-off member and a fall protection device securing the shut-off member, and at least one additional module connected releasably to the base module and at least one additional functional component.

In contrast to the fall-protected pressurized gas bottles according to the prior art, in particular in contrast to the known pressurized gas bottles with integrated valves, the pressurized gas bottle according to the invention is equipped with a modular extraction fitting, wherein the aforementioned legally prescribed requirements governing fall protection and shut-off fitting of the pressurized gas bottle are met in the base module of the extraction fitting. The additional module or the additional modules that has/have the extraction fitting in addition to the base module and that has/have the functionalities going beyond the pure shut-off function, for example additional fittings or carrying handles, is/are equipped with a connector for connection to the gas outlet of the shut-off member and with suitable devices for releasably securing the additional module on the base module (or, in the case of several additional modules, for releasably securing the additional modules to each other). The at least one additional module is connected to the base module in such a way that the fall safety of the pressurized gas bottle ensured by the base module is not impaired. This is achieved, for example, by the fact that all of the connection elements between the base module and the additional module or the additional modules are configured such that the force transmitted to the shut-off member in the event of an impact against the additional module is kept so low that it does not affect the fall safety of the pressurized gas bottle. For example, this is achieved by the provision of predetermined breaking points, zones of weakness or flexible line connections. The at least one additional module can also be equipped with a dedicated safety device which protects the respective additional functional components integrated in the additional module. This safety device meets the safety requirements placed on the respective fitting, but it does not need to meet the legal requirements governing fall safety of the pressurized gas bottle as such, since the pressurized gas bottle is in this respect already made sufficiently safe by the base module.

The base module itself is not changed when an additional module is mounted in place or when an additional module is replaced. If a change of the functionalities of the extraction fitting is desired, only the additional module or the further additional modules has to be replaced. In this way, the pressurized gas bottle can be adapted to the individual wishes of a customer, or a set of pressurized gas bottles with respectively different integrated extraction fittings (i.e. with different functionalities) can be offered, without each new type requiring dedicated approval procedures to be carried out in respect of fall safety or the shut-off fitting, or without new parts having to be constructed.

Except for the shut-off member directly connected to the pressurized gas bottle, all the other fittings and devices (here called "additional functional components") are integrated in the additional module or in the additional modules. The additional functional components in the additional module can be all of the usual fittings and devices in integrated valves, for example pressure regulator, filling or extraction attachments, electronic or analog display units, for example display units for the pressure and/or state of filling of the pressurized gas bottle. One additional functional component or a combination of several additional functional components can be provided in an additional module. Moreover, several interconnected additional modules can be provided which each contain one or more additional functional components.

In a particularly advantageous embodiment of the invention, provision is made that an operating element is integrated in the additional module and is operatively connected to the shut-off member via a connection part that extends through the additional module. When the additional module is mounted in place, the actuation of the shut-off member is in this case effected by means of the operating element. There is therefore no need for an access opening in the base module for actuation of the shut-off member, and the base module can be provided with a fall protection device at least substantially closed in the radial direction (such access openings can equally be provided in the wall of the fall protection device for maintenance reasons or for carrying out leakage tests).

The operating element comprises an actuation member, for example a handwheel, a lever, a grip part or a rotary knob, which is connected to the connection part. The connection part interacts with the valve spindle of the shut-off member, for example with form-fit engagement, and, after the additional module has been mounted in place, is connected releasably to the valve spindle. It is essential for the operating element that it is designed in such a way that an impact on the operating element cannot impair the fall safety ensured by the base module. For this purpose, the connection part is designed, for example, in the form of a flexible shaft, an articulated shaft or a plastically or elastically deformable piston is equipped with predetermined breaking points or zones of mechanical weakness.

The additional module is preferably equipped with at least one safety device that secures the at least one additional functional component against impact. This device is of the kind by which the additional functional components received in the additional module are protected from external influences but which does not play any part in the fall safety of the pressurized gas bottle in accordance with the legal requirements. For example, the safety device is a yoke, a cage or a housing that is equipped with suitable access openings for operation of the additional functional components and for attachment of the additional module to the base module.

In another advantageous embodiment of the invention, the additional module is equipped with a carrying handle or a swivel knob, which is secured for example on the housing of the additional module. Moreover, the carrying handle or the swivel knob, if appropriate in addition to further additional functional components, can be integrated in a further additional module that is connected to the first additional module.

The fall protection device of the base module is preferably screwed onto the neck ring thread of the pressurized gas bottle and is therefore easy to fit in place and, if necessary, remove again.

The fall protection device of the base module is expediently equipped with a collar portion that is supported by a shoulder of the pressurized gas bottle. The collar portion can be designed in one piece with the fall protection device or can be firmly connected thereto as an autonomous element or can be screwed onto the neck ring thread of the pressurized gas bottle. The collar portion on the one hand ensures greater strength and stiffness of the fall protection device and thus a higher degree of safety. On the other hand, it is also suitable as a surface for markings. For example, the content or the danger of the content of the pressurized gas bottle can be indicated by different colorations of the collar portions.

The modules advantageously have the appearance of a uniform and integrated extraction fitting. For example, the base module and the additional module have outer walls with a uniform outer radius, which is preferably equal to the outer radius of the pressurized gas bottle. The base module and the additional module are preferably connected fixedly but in a releasable manner to each other and to the bottle body of the pressurized gas bottle.

The pressurized gas bottles according to the invention are preferably used to store pressurized technical gases or gas mixtures, for example oxygen, nitrogen, noble gases, carbon dioxide or welding gas mixtures, medical gases or medical gas mixtures such as medical oxygen, medical air, $N_2O$ and the like, or special gases or diving gas mixtures. The pressurized gas bottles according to the invention preferably have a filling volume of between 2 liters and 50 liters and a maximum filling pressure of preferably between 50 bar and 300 bar.

Figure 2:
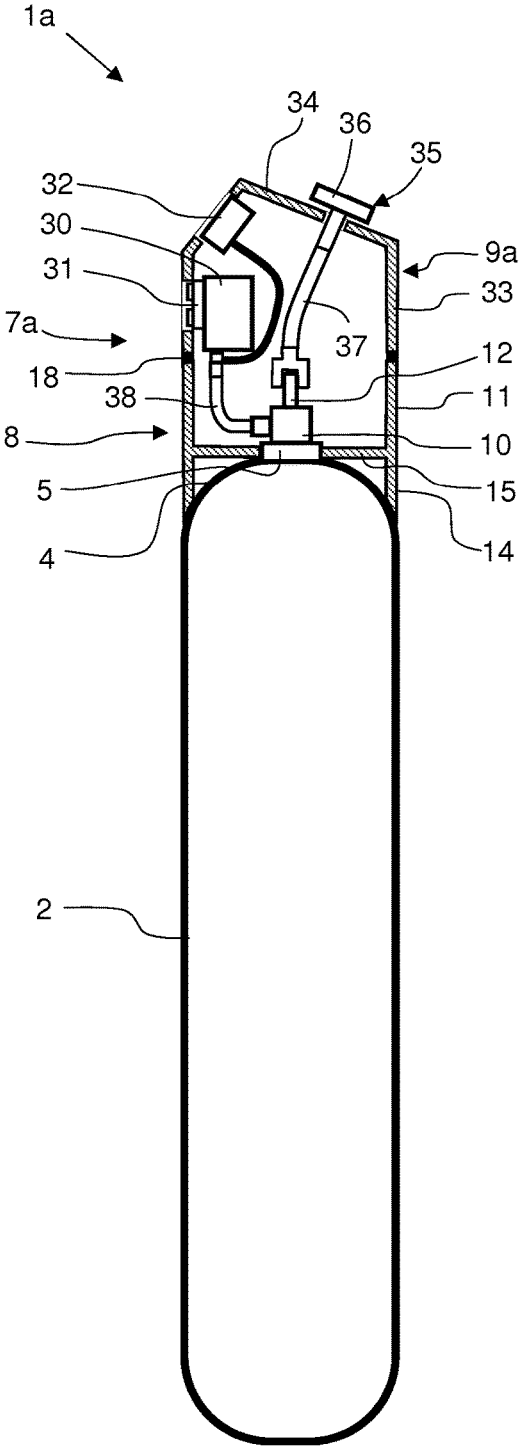

Illustrative embodiments of the invention are explained in more detail with reference to the schematic drawings, in which:

FIG. 1 shows a pressurized gas bottle according to the invention in a first embodiment, in partial cross section, FIG. 2 shows a pressurized gas bottle according to the invention in a second embodiment, again in partial cross section.

The pressurized gas bottles 1, la shown in the drawings are containers with a filling volume of between 2 l and 50 l which are designed to receive a pressurized gas, for example nitrogen, oxygen, a noble gas or a medical gas or a gas mixture, and are designed for a filling pressure of, for example, between 50 bar and 300 bar. The embodiments according to FIG. 1 and FIG. 2 differ only in terms of the functionalities of the extraction fitting that is mounted on the respective pressurized gas bottle 1, la. Otherwise, elements having an identical action in both drawings are provided with the same reference signs.

In the customary manner (not explained in any detail here), the pressurized gas containers 1, la shown in the drawings each have a bottle body 2 made, for example, of metal or of a composite material. In a likewise known manner, the pressurized gas bottles 1, la have a shoulder portion 4 and a neck ring thread 5, which is arranged about an outlet opening (not shown here).

The pressurized gas bottles 1, la are each equipped with an extraction fitting 7, 7*a* composed of modules. The extraction fittings 7, 7*a* are each composed of a base module 8, which is of identical construction in both illustrative embodiments according to FIG. 1 and FIG. 2, and an additional module 9, 9*a*, which is in each case equipped with different functionalities.

The base module 8 comprises a shut-off member 10, secured at the outlet opening of the pressurized gas bottle 1, and a fall protection device 11. The shut-off member 10 is in particular a standard bottle valve, as is often used in commercially available pressurized gas bottles and meets all the legal requirements. In a manner known per se, the shut-off member 10 has a valve spindle 12, the rotation of which causes a gas outlet 13 of the shut-off member to be opened or closed. The fall protection device 11 is, for example, a half shell, basket structure or cage structure made of metal or plastic and surrounding the shut-off member 10. In the illustrative embodiments shown here, the fall protection device 11 comprises a substantially cylindrical valve protection basket which is open at the top but otherwise closed and which extends with its side walls from the neck of the pressurized gas bottle 1, la to the height of the upper end of the valve spindle 12 and is screwed with a bottom plate 15 onto the neck ring thread 5 of the pressurized gas bottle 1, la. In the illustrative embodiments shown, the fall protection device 11 is equipped with a collar portion 14, with which the fall protection device 11 is supported by the collar portion 4 of the pressurized gas bottle 1, la and which in this way ensures increased stability of the fall protection device 11. The fall protection device 11 is designed such that it fully meets the legal requirements regarding fall protection of the respective pressurized gas bottle 1, la, specifically also when an additional module 9, 9*a* is mounted on the base module 8 of the extraction fitting 7, 7*a*.

The additional module 9 of the pressurized gas bottle 1 in FIG. 1 comprises a housing 17 with cylindrical side walls which, in terms of their circumference, correspond to the circumference of the side walls of the fall protection device 11. The housing 17 of the additional module 9 is connected to the fall protection device 11 of the base module 8 in a fixed but releasable manner, for example by a screw connection 18. Several additional functional components 19, 20, 21 are received in the interior of the housing 17. In the illustrative embodiment according to FIG. 1, these are in the form of a pressure regulator 19, an extraction attachment 20 and a pressure display 21. Further additional functional components, for example a filling attachment, further extraction attachments, actuating or reducing valves and the like can likewise be arranged inside the housing 17 but, for reasons of clarity, are not shown here. The pressure regulator is connected to the gas outlet 13 of the shut-off member 10 via a flexible attachment line 22. In the region of the additional functional components 19, 20, 21 (and optionally in the region of the further additional functional components not shown here), the housing 17 has access openings which permit access to the pressure regulator 19 and to the extraction attachment 20 and allow the display 21 to be read off even when the housing 17 is mounted in place. On its end face directed away from its neck, the housing 17 has a cover 23.

In order to permit actuation of the shut-off member 10 even when the additional module 9 is mounted in place, an operating element 24 extends through the housing 17 and has a connection part 25 that engages with a form fit around the valve spindle 12 of the shut-off member 10. On its end face directed away from the valve spindle 12, the operating element 24 is equipped with a handwheel 26 or a grip part. In the region of the handwheel 26, the cover 23 is provided with an access opening, which permits the actuation of the operating element 24 and therefore of the shut-off member 10 when the additional module 9 is mounted in place. The operating element 24 is designed such that it does not impair the fall safety ensured by the fall protection device 11. For example, the operating element comprises a hinge connection (not shown here) or is equipped with weakened zones which, in the event of a heavy impact on the operating element, prevent transmission of the impact to the shut-off member. Moreover, the extraction fitting 7, 7*a* is equipped with a carrying handle 27 that serves to facilitate the transport of the pressurized gas bottle 1. The carrying handle 27 is connected to the housing 17 in a fixed but releasable manner and can be regarded as an autonomous additional module.

The extraction fitting 7*a* of the pressurized gas bottle 1*a* shown in FIG. 2 differs from the extraction fitting 7 of the pressurized gas bottle 1 from FIG. 1 in terms of having another additional module 9*a* which is equipped with in some cases different additional functional components 30, 31, 32, namely a pressure regulator 30, a dual extraction attachment 31 and an electronic display unit 32 which, for example, displays the filling level, the pressure in the pressurized gas bottle 1*a* and/or the quantity of gas extracted. Further additional functional components can likewise be present but are not shown here. The additional functional components 30, 31, 32 are received in a housing 33 of the additional module 9*a* which, like the housing 17, is connected in a fixed but releasable manner to the fall protection device 11 of the base module 8 and, in the region of the additional functional components 30, 32, 32, is equipped with corresponding access openings. Instead of having a flat cover, the housing 33 has an at least in part conically shaped head portion 34, which makes it easier to read the display unit 32. In the same way as in the additional module 9, an operating element 35 is also provided here for actuation of the shut-off fitting 10 when the additional module 9*a* is mounted in place. The operating element 35 extends through the housing 33 and has a handwheel 36 protruding from the head portion 34, and also a connection part 37 which is operatively connected to the handwheel 36 and to the valve spindle 12 of the shut-off member 10 and which, in the illustrative embodiment shown here, is made at least in part from a flexible material, for which reason, in the event of the handwheel 36 suffering a heavy impact, the shut-off member 10 is not acted upon by a force that puts safety at risk. An attachment line 38 serves to connect the pressure regulator 30 to the shut-off member 10.

Like the housing 17, the housing 33 serves primarily to protect the additional functional components 19, 20, 21; 30, 31, 32 received inside the respective housing 17, 33. By contrast, the housings 17, 33 have no importance as regards the fall safety of the pressurized gas bottle 1, la.

If necessary, the functionalities of the extraction fittings 7, 7*a* can be easily modified by removing the additional module 9, 9*a* from the base module 8 and replacing it with another additional module which has the desired functionalities, and which is then connected to the base module 8. In this case, the housing 17, 33 simply has to be released from the fall protection device 11, and the connection part 25, 37 from the valve spindle 12, and the attachment line 22, 38 has to be separated from the gas outlet 13 of the shut-off member 10. Similarly, the additional module 9, 9*a* can be replaced, for example if an additional functional component 19, 20, 21; 30, 31, 32 is damaged beyond repair. Similarly, the extraction fitting 7 from FIG. 1 can be supplied with or without the carrying handle 27 or with another carrying handle, depending on the wishes of the customer. Despite the changes that are thus made to the functionality of the pressurized gas bottle 1, la, renewed testing of fall safety is unnecessary since the base module 8 is unchanged.

LIST OF REFERENCE SIGNS

1, 1*a* pressurized gas bottle
2 bottle body
3 -
4 shoulder portion
5 neck ring thread

6 -
7, 7*a* extraction fitting
8 base module
9, 9*a* additional module
10 shut-off member
11 fall protection device
12 valve spindle
13 gas outlet
14 collar portion
15 bottom plate
16 -
17 housing
18 screw connection
19 pressure regulator
20 extraction attachment
21 pressure display
22 attachment line
23 cover
24 operating element
25 connection part
26 handwheel
27 carrying handle
28 -
29 -
30 pressure regulator
31 extraction attachment
32 display unit
33 housing
34 head portion
35 operating element
36 handwheel
37 connection part
38 attachment line

The invention claimed is:

1. A pressurized gas bottle with an extraction fitting comprising:

a shut-off member mounted on the pressurized gas bottle;

a functional component attached to the shut-off member; and a fall protection device securing the shut-off member against inadmissible damage, characterized in that:

the extraction fitting has a modular design and comprises a base module having the shut-off member and the fall protection device, and an additional module having the functional component, wherein the base module is configured to be secured to the pressurized gas bottle, and the additional module is releasably connected to the base module such that when forcible impact is made to the extraction fitting, the additional module decouples from the base module to thereby prevent damage to the shut-off member and inadvertent release of gas from the pressurized gas bottle.

2. The pressurized gas bottle as claimed in claim 1, characterized in that the functional component is one of a pressure regulator, an extraction attachment, and a display unit.

3. The pressurized gas bottle as claimed in claim 1, characterized in that an operating element is integrated in the additional module and is operatively connected to the shut-off member via a connection part that extends through the additional module.

4. The pressurized gas bottle as claimed in claim 1, characterized in that the additional module is equipped with a safety device that secures the functional component against impact.

5. The pressurized gas bottle as claimed in claim 1, characterized in that the additional module is equipped with a carrying handle or a swivel knob.

6. The pressurized gas bottle as claimed in claim 1, characterized in that the fall protection device is screwed onto a neck ring thread of the pressurized gas bottle.

7. The pressurized gas bottle as claimed in claim 1, characterized in that the fall protection device has a collar portion that contacts and is supported on a shoulder of the pressurized gas bottle.

8. The pressurized gas bottle as claimed in claim 1, characterized in that the base module and the additional module are cylindrical and have the same outer circumference.

9. The pressurized gas bottle as claimed in claim 1, characterized in that the additional module can be exchanged with a second additional module without the pressurized gas bottle having to be emptied or the base module having to be decoupled from the pressurized gas bottle.

10. An extraction fitting for a pressurized gas bottle having an outlet, the extraction fitting comprising:

a base module having a shut-off member configured to couple to the outlet and selectively close the outlet, and a fall protection device configured to couple to the pressurized gas bottle and surround the shut-off member to thereby prevent damage to the shut-off member; and an additional module having a housing releasably coupled to the fall protection device and an operating element operably and releasably coupled to the shut-off member;

wherein when forcible impact is made to the extraction fitting, the housing decouples from the fall protection device and the operating element decouples from the shut-off member to thereby prevent damage to the shut-off member and inadvertent release of gas from the pressurized gas bottle.

11. The extraction fitting according to claim 10, wherein the fall protection device extends in a direction away from the pressurized gas bottle and past the shut-off member.

12. The extraction fitting according to claim 10, wherein the fall protection device and the housing define a zone of weakness along which the housing decouples from the fall protection device when forcible impact is made to the extraction fitting.

13. The extraction fitting according to claim 10, wherein the additional module can be decoupled from the base module and replaced with a second additional module without decoupling the base module from the pressurized gas bottle.

14. The extraction fitting according to claim 10, wherein the shut-off member has a gas outlet through which the gas is selectively released, and wherein the additional module has a functional component coupled to the housing and releasably coupled to the gas outlet with a flexible attachment line such that when forcible impact is made to the extraction fitting, the functional component decouples from the flexible attachment line or the flexible attachment line decouples from the gas outlet to thereby prevent damage to the shut-off member.

15. The extraction fitting according to claim 14, wherein the functional component is a pressure regulator with an extraction attachment through which the gas is dispensed.

16. The extraction fitting according to claim 14, wherein the functional component is one of a plurality of functional components that are coupled to the housing.

17. The extraction fitting according to claim 14, wherein the additional module has a safety device that secures the functional component to the housing and prevents damage to the functional component when forcible impact is made to the extraction fitting.

18. The extraction fitting according to claim 10, wherein the fall protection device is configured to couple to a neck ring thread of the pressurized gas bottle.

19. The extraction fitting according to claim 10, wherein the fall protection device has a collar portion that is configured to contact a shoulder of the pressurized gas bottle such that the base module is supported on the pressurized gas bottle.

* * * * *